United States Patent [19]

Herbert

[11] Patent Number: 4,508,400

[45] Date of Patent: Apr. 2, 1985

[54] ELECTRICAL SUPPLY CONNECTOR FOR CONTINUOUS OUTLET TRACK

[75] Inventor: Tony E. G. Herbert, East Sussex, England

[73] Assignee: Rotaflex p.l.c., London, England

[21] Appl. No.: 434,732

[22] Filed: Oct. 18, 1982

[51] Int. Cl.[3] ..... H01R 25/14

[52] U.S. Cl. ..... 339/22 R

[58] Field of Search ..... 339/21 R, 21 S, 22 R, 339/22 B, 22 T, 74, 75 R, 75 M

[56] References Cited

U.S. PATENT DOCUMENTS 2,659,874 11/1953 Veitch ..... 339/22 T
3,910,667 10/1975 Heritage ..... 339/22 R

FOREIGN PATENT DOCUMENTS 968432 5/1975 Canada ..... 339/22 R
2210516 9/1973 Fed. Rep. of Germany .

*Primary Examiner*—Neil Abrams
*Attorney, Agent, or Firm*—Arthur B. Colvin

[57] ABSTRACT

A supply connector for an electrical distribution system of the continuous outlet type having a track in the form of a channel (1) housing longitudinally extending conductors (4) is adapted to be inserted through the mouth of the channel and accommodated entirely within the channel. The connector includes longitudinally extending contacts (15) adjustable between retracted positions within the connector housing and operative positions projecting from the housing by a cam member (20) which is slidable in the housing and driven by a rack and pinion mechanism (29,30), the pinion being formed as a toothed quadrant fast with an operating lever (31).

11 Claims, 6 Drawing Figures

ELECTRICAL SUPPLY CONNECTOR FOR CONTINUOUS OUTLET TRACK

This invention relates to electrical supply systems and in particular to such systems of the type comprising a supply track in the form of an elongate channel housing a plurality of conductors extending longitudinally of the channel, a supply connector including terminals for connection of electricity supply leads and contacts connected electrically to the terminals and arranged to contact the track conductors on engagement of the connector in the track for supplying electrical power to the conductors, and one or more adaptors engageable in the track at any selected position along its length and including contacts engageable with the conductors for supplying electric power to an electrical appliance wired to the adaptor. The invention is especially concerned with a novel supply connector for such an electrical supply system.

In electrical supply systems of the kind described above which are currently available on the market, the supply connectors are all fitted to an end of the track by pushing the connector through the open end of the track. Unlike the adaptors which must project to a greater or lesser extent through the open mouth of the track in order that they may be inserted into and removed from the track at will, once the supply connector is fitted to the track it is not necessary or usual for it to be removed or adjusted so fitting it into the track through the end of the channel has the advantage that the connector need not protrude through the channel mouth and in some cases can be accommodated entirely within the channel with clear benefits from an aesthetic point of view. Having to push the connector in through the end of the track also has some disadvantages, however. The normal installation procedure is to wire the connector to the electricity supply leads and insert it into the track after the latter has been mounted in position, which means that sufficient space must be left at the end of the track to enable the connector to be fitted to the track. In addition, a certain amount of slack is inevitably left in the supply leads which are not then always easy to conceal and they can be unsightly if left exposed to view.

The present invention aims at eliminating or reducing the above disadvantages by providing a supply connector for an electrical supply installation of the kind initially described, which is arranged to be inserted into the track through the open mouth of the channel and to be accommodated substantially entirely within the channel.

By making the connector so that it can be inserted through the open mouth of the channel a space is no longer needed at the end of the track which may be mounted to abut against a wall, for example, should this be desirable in any installation. The slack in supply leads can be reduced and they may be more easily concealed in the track. Furthermore, the connector may be positioned away from the track end should this prove convenient or desirable. At the same time the advantage of the connector being completely concealed within the track is not surrendered.

Supply connectors for continuous outlet electrical distribution tracks should not be confused with the adaptors which are fitted to the track and serve as current take-off devices for supplying power to electrical appliances. The most fundamental requirement of an adaptor is that it should be insertable into the track through the channel mouth and at any selected position along the track length. This versatility of the adaptors is an important feature of track systems. In contrast supply connectors have in the past always been so made that they must be inserted into the end of the track. The additional advantages which accrue from the extra versatility obtained by making the supply connector so that it can be introduced into the track through the channel mouth have hitherto gone unrecognized, in spite of the fact that supply connectors are used side by side with adaptors. Although it might be thought surprising this confirms the point that supply connectors are as a practical matter looked upon in the art as quite different to adaptors.

In British Patent specification No. GB 1,436,707 there is proposed a supply connector which is illustrated in FIGS. 5–7 of said specification and comprises a generally rectangular body in which are mounted terminals for connection of the current supply leads and elongate contacts extending generally in parallel and longitudinally of the body, each contact having one end connected to a terminal and the other end protruding laterally through an opening in the body. Although the body is adapted to be inserted through the open end of the track member a modification is suggested to enable it to be introduced through the channel mouth. A second component of the connector consists of a mechanical wedge which is inserted into the track channel and moved longitudinally to engage with a wedging action between the body and a side wall of the track channel in order to clamp the body to the track and press the contacts into engagement with the track conductors. The wedge includes a portion which projects through the mouth of the track channel to enable it to be displaced and a locking screw must be tightened to hold the wedge and body assembled in the operative position. The supply connector disclosed in the prior specification has several drawbacks. It is suitable only for use with tracks having conductors supported at one side only of the track channel, whereas many supply tracks have conductors at both sides. With the connector being made in two separate parts there is a danger that the wedge may not be assembled properly with the body, or it could even be omitted completely. Since the wedge serves to clamp the body to the track and to press the contacts against the conductors it is difficult to ensure that the correct clamping and contact pressures are achieved. Furthermore, a part of the connector protrudes through the channel mouth and detracts from the visual appearance.

According to the present invention there is provided a supply connector for connecting to a source of electric current the conductors of a current distribution track member having an elongate channel housing a plurality of conductors extending longitudinally of the channel, the connector comprising a generally rectangular housing dimensioned to be received in the channel, a plurality of terminals mounted in the housing for connection of electric current supply leads, a plurality of elongate electrical contacts mounted to extend generally in parallel and longitudinally of the housing, each contact having one end connected to one of the terminals and the other end arranged to protrude laterally through an opening in the housing for engaging a respective conductor of the track member, and a cam member movable longitudinally of the housing for adjusting said other ends of the contacts laterally for engaging the track conductors, characterized in that the contacts are resilient and mounted in cantilever manner adjacent said one ends to enable the other free ends thereof to move between retracted positions within the housing and operative positions projecting through the housing openings, the cam member is slidable in the housing and cooperates with the contacts for adjusting the free ends of the contacts between their retracted and operative positions, and drive means is coupled to the cam member for displacing the cam member longitudinally of the housing and contacts and includes an operating member movably mounted to the housing, the connector, with the contacts retracted, being insertable as a unit into the track channel through the mouth thereof after which the operating member is operable to adjust the contacts into their operative positions for engaging the track conductors with the connector supported by and accommodated substantially entirely within the track member.

As the contacts can be selectively withdrawn into the housing contacts can be arranged to project from both sides of the housing for engaging conductors mounted on opposite sides of the track channel. The connector is insertable into the channel as a unit and once in position the mounting procedure is completed in a simple manner by manipulation of the operating member. The connector construction remains comparatively simple through the use of resilient cantilevered contacts.

Most of the supply tracks currently available on the market have channels of such a small width that there is insufficient space available for a rotary cam for acting directly on resilient cantilevered contacts, but by employing a sliding cam member in the supply connector of the invention it has been found possible to use such contacts, which are preferred since they preclude the need for separate springs or more complex contact arrangements, thereby simplifying assembly procedures and costs.

In a preferred embodiment of the invention the drive means comprises a rack and pinion drive including a rack connected to the cam member for displacement therewith and a pinion in mesh with the rack and having its axis normal to the housing side walls, the operating member being a lever fast with the pinion and actuable from outside of the housing for adjusting the contacts between their extended and retracted positions. The rack and pinion drive ensures an adequate mechanical advantage for displacing the cam member which assists to enable the operating parts to be received entirely within the track channel.

The pinion may conveniently consist of a toothed quadrant fast with the lever, and the latter may be L-shaped and have one limb fixed to the pinion while the other limb is arranged to lie against the bottom wall of the housing when the contacts are extended.

In order to easily control the contact pressures between the contacts and track conductors it is preferred that the contacts be urged to the operative positions by their inherent resilience and the cam member be arranged to act on the contacts to cam them inwardly to the retracted positions. To relieve the contacts of load bearing forces the connector is preferably provided with laterally projecting receiving elements for engaging the track to support the connector, and the cam member arranged to hold these elements in firm engagement with the track when the contacts are extended. Conveniently the elements are resilient tongues integral with the side walls of the housing.

A more complete understanding of the invention will be had from the following detailed description, reference being made to the accompanying drawings in which.

Figure 1:
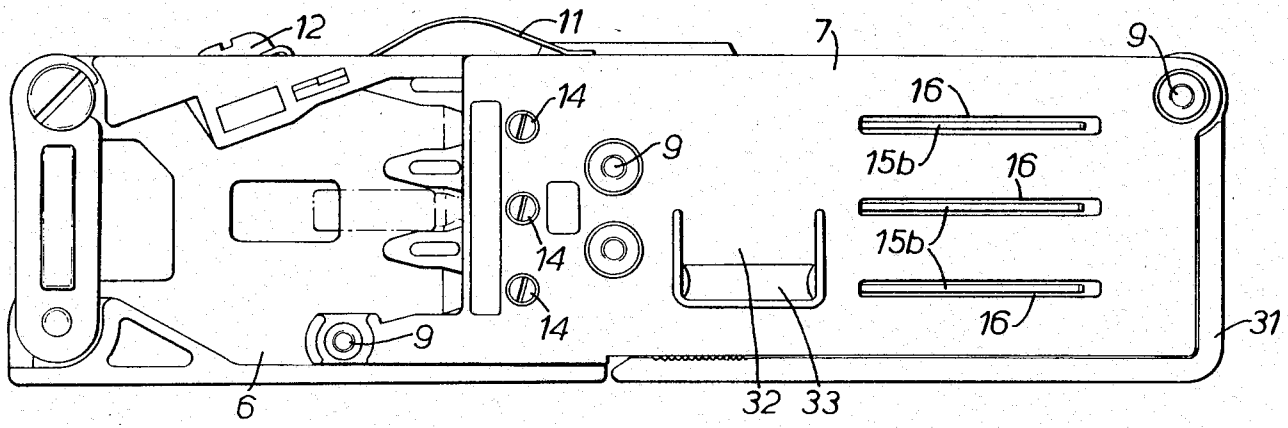
FIG. 1 is a side view of a connector in accordance with the invention.
Figure 2:
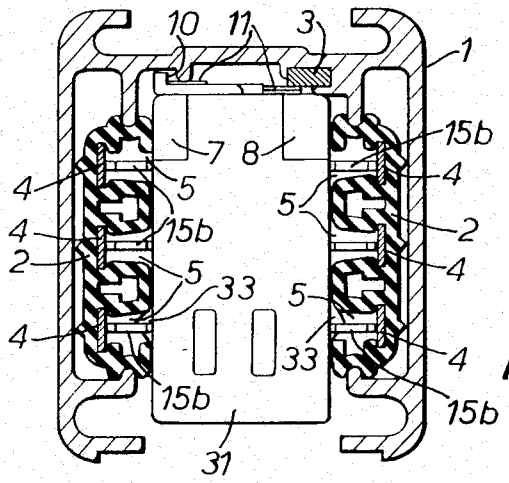
FIG. 2 is a view showing the connector in end elevation and fitted within a track which is shown in cross-section.

The supply connector illustrated in the drawing is intended for use with a track of the form shown in FIG. 2 and comprising an elongate channel 1 of uniform profile carrying electrically insulating inserts 2 adjacent the inner side walls of the channel, and an earth conductor 3 running along the inner end wall. Each insert 2 supports three longitudinally extending conductors 4 contact with which can be made from the inside of the channel through continuous slots 5 defined by the inserts. The connector of the invention is inserted into the track for supplying electrical power to the track conductors 4, adaptors being engageable in the track at any position along its length for connecting the conductors to electrical apparatus or appliances, e.g. lighting equipment wired to the adaptors.

The connector comprises a body 6 moulded from electrically insulating material, and a housing formed by two covers 7, 8 fitted to the opposite sides of the body 6 and held in place by screws or eyelets 9. With exception of an optional polarising element 10 described in more detail below, the connector is symmetrical with respect to its midplane. A bifurcated, resiliently bowed earth contact 11 is mounted on the body 6 for contact with the earth conductor 3 of the track, and is held by a screw 12 which acts as a terminal for an earth lead of the supply cable (not shown). At one end (hereinafter referred to as the inner or forward end) the body carries a cable clamp for gripping the supply cable. On each side the body 6 carries three terminal blocks 13, the clamping screws 14 of which are accessible through holes provided in the housing covers 7,8. A respective unitary contact element 15 is connected at one end to each terminal block and extends rearwardly in cantilever fashion substantially longitudinally of the connector. Each contact includes a resilient stem portion 15*a* and a comparatively rigid blade portion 15*b* bent to lie in plane normal to the stem portion. The blade portions 15*b* are aligned with respective elongated slots 16 formed in the housing for the contacts 15 to protrude fron the housing to engage the track conductors 4 as seen in FIG. 2. The stem portions of the contacts mounted on opposite side of the body 6 are separated by a flange 17 having having longitudinal notches 18 to assist in guiding a slide assembly arranged for longitudinal sliding movement.

Figure 3:
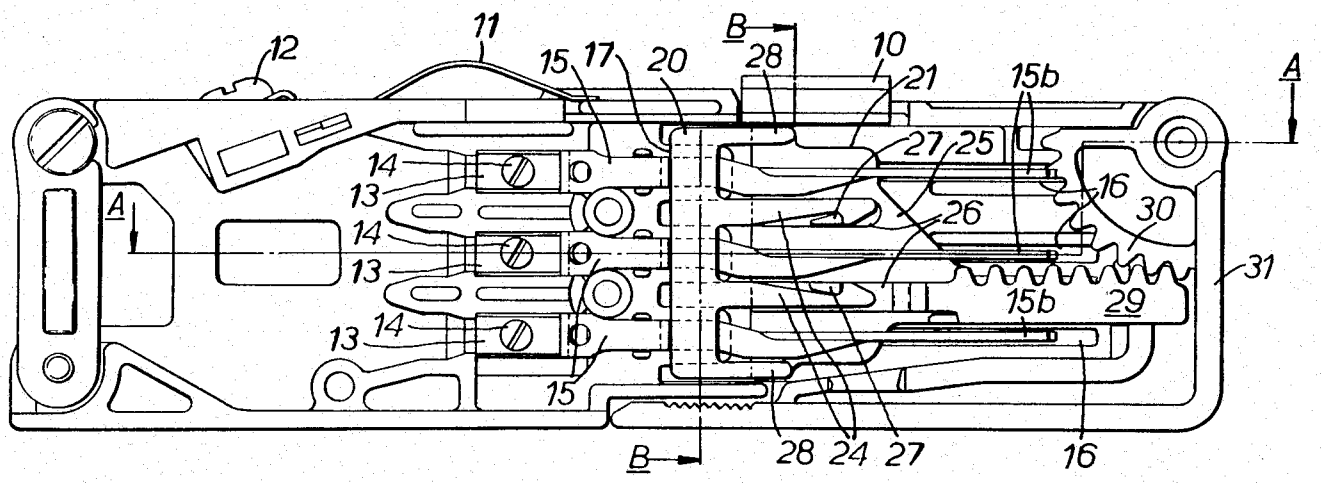
FIG. 3 is a side view of the connector with the adjacent side of the housing removed.
Figure 4:
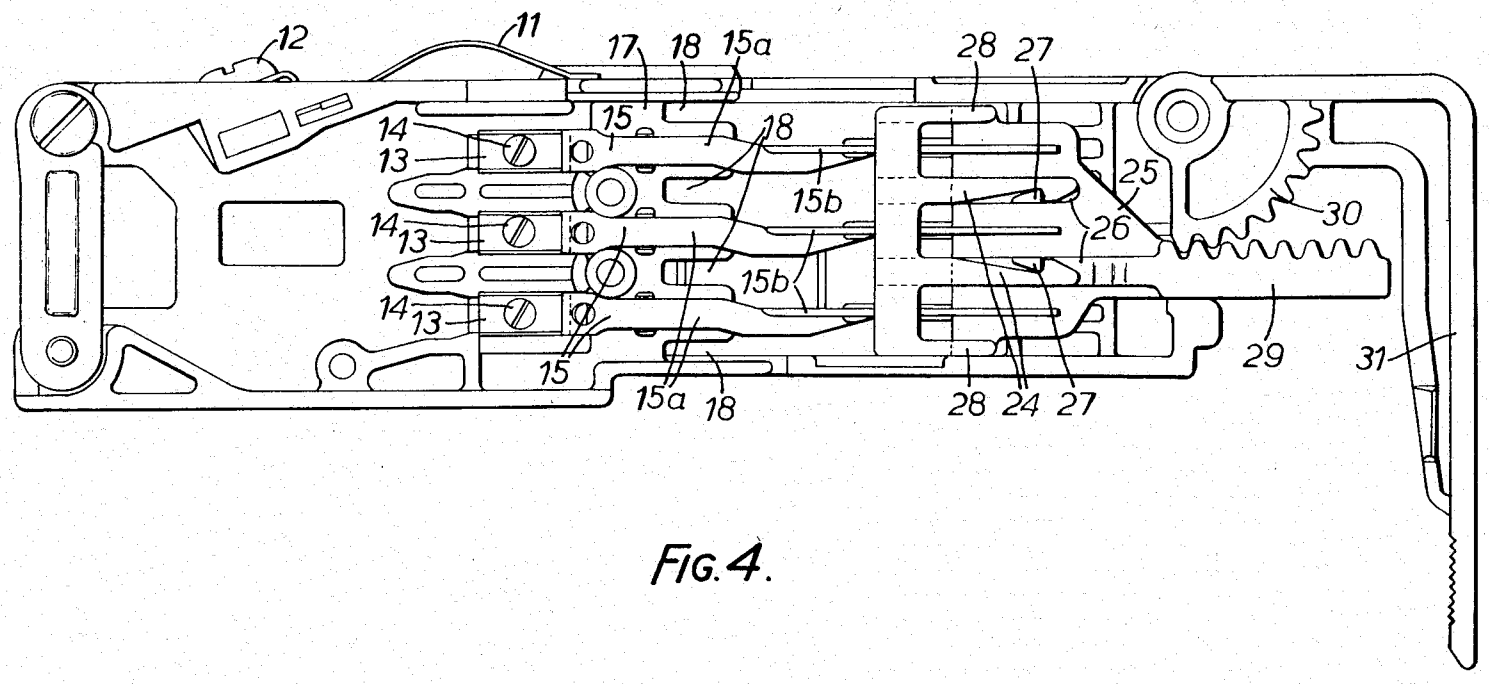
FIG. 4 is a similar view to FIG. 3 but showing the connector with the contacts in a retracted condition ready for insertion into or removal from a track.
Figure 5:
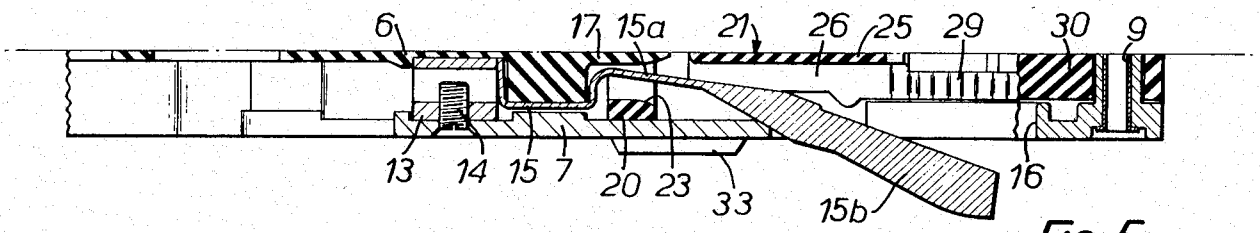
FIG. 5 is a half section taken along the line A—A in FIG. 3, the half not illustrated being a mirror image of that shown.

The slide assembly consists of two moulded members 20,21, the first of which has three windows 22 through which pairs of adjacent contacts 15 respectively pass, and the inwardly facing sides of which define cam surfaces 23 for acting on the respective contacts. The cam member 20 also includes on each side a pair of rearwardly projecting latch fingers 24 with opposed hooks. The second member 21 of the slide assembly includes a central part 25 on each side of which is formed a pair of wings 26 aligned with the fingers 24 and extended by tip projections 27 with which the hooks of the fingers 24 engage to hold the two members 20,21 firmly together, with the part 25 engaged in central slots provided in top and bottom extension tongues 28 of member 20. The member 21 includes a rack comprising a pair of legs 29 extending rearwardly from part 25 and toothed on their upper surfaces. In meshing engagement with the rack is a toothed quadrant 30 journalled on an axle provided by a pair of aligned spigots on the housing covers 7,8 and through which one of the fixing screws or eyelets 9 is fitted. Integral with the quadrant 30 is an L-shaped actuating lever 31 which is movable between the two positions illustrated in FIGS. 3 and 4 to cause the slide assembly to be driven to and fro within the connector housing by the rack and pinion mechanism 29,30. The sliding movement of the slide assembly is guided by the body 6 and housing 7,8, and when driven rearwardly from the forwardmost position (FIG. 3) in which the contact blades 15*b* protrude through the housing slots 16 due to the resilience of the stem portions 15*a*, the cam surfaces 23 are moved into engagement with the contacts and press them inwardly to cause the blades to be retracted into the housing through the slots 16.

Each housing cover 7,8 is provided with a resilient tongue 32 defined by a U-shaped slot and provided with a laterally protruding rib 33 adjacent the free end. These tongues serve to support the connector within the track 1 relieving the contacts 15 of mechanical loads, by virtue of the ribs 33 engaging in the lowermost slots 5 of the track inserts 2, as seen in FIG. 2. The tongues 32 are able to deflect inwardly on insertion of the connector into the track, but when the cam member 20 is moved to its forwardmost position to release the contacts to engage the track conductors, it is positioned behind the tongues 32 and locks them in engagement with the track so that the connector cannot be removed from the track without first retracting the contacts 15.

Figure 6:
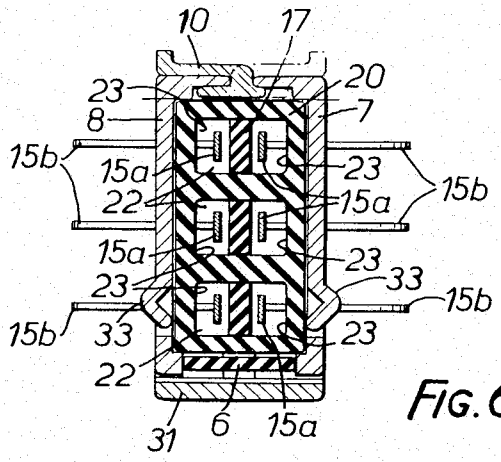
FIG. 6 is a section taken along the line B—B in FIG. 3.

The polarising element 10 (see FIGS. 2, 3 and 6) is optional and may be inserted either way round between the top flanges of the covers 7,8. If used and attempt is made to introduce the connector into the track the wrong way round the element 10 abuts the earth conductor 3 and prevents complete insertion. If the connector is then turned around the correct way proper insertion is possible, as seen in FIG. 2.

In use of the connector the supply leads are connected to the contact terminals 13 and earth terminal 12, after which the connector may be inserted into the track at either end and either way round (assuming the polarising element is correctly inserted if used) through the open mouth of the track channel. For this purpose the lever 31 is moved to its FIG. 4 position so that the contact blades 15*b* are withdrawn into the housing by the slide assembly 20,21. The connector is then pushed into the track bringing the earth contact 11 into engagement with the conductor 3, and the ribs 33 of tongues 32 snap into the slots 5 of track inserts 2. The lever 31 is then rotated to the FIG. 3 position in which its limbs lie closely against the end and bottom walls of the housing, respectively, causing the slide assembly to be driven forwardly releasing the contacts so that the blades 15*b* move out through the slots 16 and engage the respective conductors 4 of the track, and locking the mechanical securing tongues 32 against release. If desired means may be provided to retain the lever in FIG. 3 position and may be arranged to engage automatically with a snap action when the lever is adjusted to this position.

The use of the lever working in a plane normal to the mouth of the track to actuate a rack and pinion system ensures an adequate mechanical advantage to displace the cam assembly controlling the cantilevered contacts, with the result that the connector may be inserted into a track through the channel mouth and be contained wholly within the track.

Having thus described the invention and illustrated its use, what is claimed as new and is desired to be secured by Letters Patent is:

1. A supply connector for connecting to a source of electrical current the conductors of a current distribution track member having an elongate channel housing a plurality of conductors extending longitudinally of the channel, the connector comprising a generally rectangular housing, a plurality of terminals mounted in the housing for connection of electric current supply leads, a plurality of resilient elongate electrical contacts mounted to extend generally in parallel and longitudinally of the housing, each contact having one end connected to one of the terminals and the other end arranged to protrude laterally through an opening in a side wall of the housing for engaging a respective conductor of the track member, and each contact being mounted in cantilever manner adjacent said one end to enable the other free end thereof to move between a retracted position within the housing and an operative position projecting through the housing opening, said free ends being yieldably urged toward said operative position by the resilience of said contacts, said one end of each said contact being mounted in closer proximity to said side wall than to the opposite housing side wall, a cam member slidable longitudinally in the housing and arranged to cooperate with the contacts for shifting said free ends of said contacts from said operative to said retracted position, and drive means coupled to the cam member for displacing the cam member longitudinally of the housing and the contacts, said drive means including an operating member movably mounted to the housing and operable either to retract the contacts, thereby to enable the connector to be inserted into the track channel through the mouth thereof, or to release the contacts into their operative positions for engaging the track conductors, the connector being supported by and accommodated substantially within the track member with the longitudinal axes of the track member and housing being substantially parallel when the contacts are engaged with the track conductors.

2. A supply connector according to claim 1, wherein at least one pair of contacts is mounted to protrude through opposite sides of the housing, the cam member has an opening through which said pair of contacts pass, and cam surfaces at the opposite sides of said opening are arranged to cooperate with the respective contacts of said pair.

3. A supply connector according to claim 1, wherein the drive means comprises a rack and pinion drive including a rack fixed to the cam member and a pinion pivoted to the housing to rotate about a lateral axis normal to the sides of the housing.

4. A supply connector according to claim 3, wherein the pinion is a toothed quadrant and the operating member is a lever fast with said quadrant.

5. A supply connector according to claim 4, wherein the lever is L-shaped with a first arm fixed to the quadrant and a second arm arranged to lie against the bottom wall of the housing when the contacts are adjusted into their operative positions.

6. A supply connector according to claim 1, wherein the cam member is guided for sliding movement by the connector housing.

7. A supply connector according to claim 1, wherein the terminals and contacts are supported by an inner body enclosed by said housing.

8. A supply connector according to claim 1, wherein securing elements project laterally from the housing for engaging the track member to support the connector therein, the elements being retractable to enable insertion and removal of the connector into and out of the track member, and the cam member being adapted to locate behind said elements when the contacts are adjusted into their operative positions for retaining said elements in engagement with the track member.

9. A supply connector according to claim 8, wherein said securing elements are formed integrally with the housing.

10. A supply connector according to claim 1, wherein the housing is symmetrical to either side of a longitudinal plane, and a reversible polarising element is fitted optionally to the housing whereby the housing may be inserted into the track member in only one pre-selected orientation of the connector.

11. An electric current distribution system comprising an elongate track member having a channel housing a plurality of conductors extending longitudinally of the channel, and a supply connector insertable into the channel for connecting the conductors to a source of electric current, the supply connector being as defined in accordance with claim 1.

* * * * *